US008991291B2

(12) United States Patent
Holcomb et al.

(10) Patent No.: US 8,991,291 B2
(45) Date of Patent: Mar. 31, 2015

(54) MULTIPLE SLICING DEVICE

(71) Applicant: Chef'n Corporation, Seattle, WA (US)

(72) Inventors: David A. Holcomb, Seattle, WA (US); Matthew Krus, Seattle, WA (US); Adam A. Jossem, Seattle, WA (US); Jonah S. Griffith, Seattle, WA (US); David Hull, Seattle, WA (US)

(73) Assignee: Chef'n Corporation, Seattle, WA (US)

( * ) Notice: Subject to any disclaimer, the term of this patent is extended or adjusted under 35 U.S.C. 154(b) by 0 days.

(21) Appl. No.: 13/768,808

(22) Filed: Feb. 15, 2013

(65) Prior Publication Data

US 2013/0152405 A1 Jun. 20, 2013

Related U.S. Application Data

(63) Continuation of application No. 12/718,640, filed on Mar. 5, 2010, now Pat. No. 8,459,160.

(60) Provisional application No. 61/161,676, filed on Mar. 19, 2009.

(51) Int. Cl.

| | |
|---|---|
| ***B26D 3/26*** | (2006.01) |
| ***B26D 7/06*** | (2006.01) |
| ***B26B 27/00*** | (2006.01) |
| ***B26D 1/553*** | (2006.01) |

(52) U.S. Cl.

CPC ..... *B26B 27/00* (2013.01); *B26D 1/553* (2013.01); *B26D 7/0608* (2013.01)

USPC ..... 83/425.3; 83/431; 30/279.2

(58) Field of Classification Search

USPC ..... 83/425.3, 431; 99/493, 508, 506, 510, 99/495, 485, 509; 30/286, 287, 279.2; 241/92, 95, 168, 169, 169.1, 169.2; D7/674, 693, 381, 678, 665, 666; 100/334, 126, 243, 112, 125, 234, 131, 100/213, 110, 116

See application file for complete search history.

(56) References Cited

U.S. PATENT DOCUMENTS

| | | | | | |
|---|---|---|---|---|---|
| 533,164 | A | * | 1/1895 | Criswell | 83/435.19 |
| 853,796 | A | * | 5/1907 | Imes et al. | 83/435.19 |
| 1,947,153 | A | * | 2/1934 | Dellinger | 83/435.18 |
| 2,016,596 | A | | 10/1935 | De Hymel | |
| 3,774,490 | A | | 11/1973 | Gerson | |
| 5,245,902 | A | * | 9/1993 | Pereira | 83/435.19 |
| 5,513,562 | A | | 5/1996 | Moor | |
| 5,520,105 | A | * | 5/1996 | Healy | 100/98 R |
| D507,726 | S | | 7/2005 | Holcomb et al. | |
| D515,884 | S | | 2/2006 | Holcomb et al. | |

(Continued)

FOREIGN PATENT DOCUMENTS

| | | |
|---|---|---|
| GB | 486487 | 6/1938 |
| KR | 753007 B1 | 8/2007 |

*Primary Examiner* — Ghassem Alie

(74) *Attorney, Agent, or Firm* — Seed IP Law Group PLLC

(57) ABSTRACT

A multiple slicing device includes a frame including a receptacle and a plurality of cutting elements, and a working portion including an activation mechanism, a cam mechanism, and a forcing member. The activation mechanism can include two handles where moving one of the handles toward the other handle collapses the forcing member via the cam mechanism, onto a food item placed in the receptacle between the forcing member and the cutting elements, to efficiently and simultaneously cut or slice the food item into multiple pieces.

5 Claims, 6 Drawing Sheets

(56) References Cited

U.S. PATENT DOCUMENTS

| | | | | |
|---|---|---|---|---|
| 7,000,535 | B2 | 2/2006 | Harrison-Griffin et al. | |
| 7,080,454 | B2 | 7/2006 | Holcomb et al. | |
| 7,296,762 | B2 * | 11/2007 | Dorion | 241/169 |
| 7,302,887 | B1 * | 12/2007 | Chapman et al. | 100/234 |
| D581,221 | S | 11/2008 | Hull | |
| D604,123 | S | 11/2009 | Krus et al. | |
| 7,648,092 | B2 | 1/2010 | Wong et al. | |
| 8,322,277 | B2 * | 12/2012 | Griffith | 100/234 |
| 2001/0047726 | A1 * | 12/2001 | Zarlengo | 100/132 |
| 2007/0028785 | A1 | 2/2007 | Foster et al. | |
| 2009/0078100 | A1 * | 3/2009 | Repac | 83/425.3 |

* cited by examiner

MULTIPLE SLICING DEVICE

BACKGROUND

1. Technical Field

The present disclosure is generally related to food processing devices, and more particularly, to a multiple slicing device manually operable to simultaneously slice food items into multiple pieces.

2. Description of the Related Art

Slicing food items has long been important in consumption and preparation of food. Some items are often sliced in multiple pieces for immediate consumption, such as a variety of fruits. Food items that serve as ingredients for other foods are also often sliced to a suitable size for being cooked with other ingredients. Other slicing applications include slicing food items to particularly sized or shaped pieces for aesthetic appearance or creating aesthetic patterns. Conventional methods and devices for cutting or slicing food items are time-consuming and/or complicated. A common conventional method is to use a single blade cutting device such as a knife. However, this method is time-consuming. It is also difficult to obtain substantially identical slices using a knife, which may be desirable for aesthetic or functional purposes. In addition, a knife cannot be used to simultaneously slice a piece of food into multiple pieces.

Other devices have included electric powered and manual devices with complicated mechanisms that require two hands to operate and/or make it difficult to control the size or shape of the slices. These devices are also time-consuming to clean and expensive to repair.

DETAILED DESCRIPTION

Figure 1:
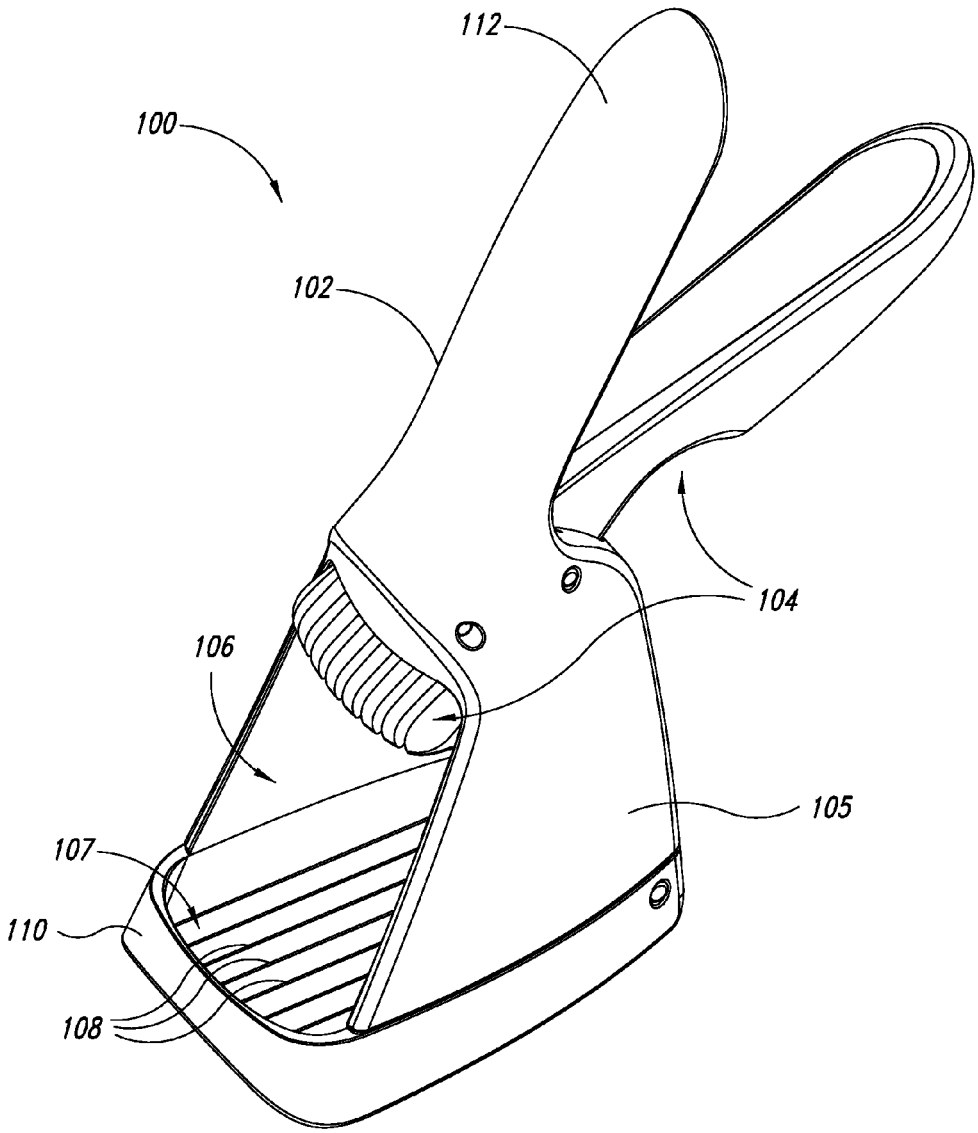
FIG. 1 is an isometric view of a multiple slicing device according to one embodiment.

FIG. 1 illustrates a slicing device 100 according to one embodiment. The slicing device 100 is manually operable to allow a user simultaneously divide a food item into multiple pieces using one hand, for example into parallel sliced and equally thick slices. In one embodiment, the slicing device 100 includes a frame 102 and a working portion 104 operatively coupled with respect to the frame 102. The frame 102 includes a housing 105 forming a receptacle 106 sized and shaped to receive a food item, such as mushrooms, banana, tofu, avocado, cheese or any other food item that the user intends to slice into multiple pieces.

The frame 102 further includes a first handle 112 extending from a first portion of the housing 105. In one embodiment, the first handle 112 is fixedly coupled or attached to the housing 105, or is formed from a unitary body of material with the housing 105. The frame 102 further includes a base 110, which can be an integral portion of the housing 105, or it can be a separate component removably or fixedly coupled to the housing 105. The base 110 can be positioned or located toward a second portion of the housing 105, spaced from the first portion from which the first handle 112 extends.

The multiple slicing device 100 further includes a plurality of cutting elements 108 spaced apart from each other at equal or non-equal distances. In one aspect, the cutting elements 108 are fixedly coupled to the frame 102 toward the base 110. In one aspect, the cutting elements 108 are directly coupled to the base 110, the base 110 acting as a frame for the cutting elements 108.

In the illustrated embodiment of FIG. 1, the base 110 includes an opening 107, the cutting elements 108 being mounted to extend across the opening 107 and extending parallel to one another and/or mounted with substantially equal spacing therebetween. In other embodiments, the cutting elements 108 can be non-parallel and/or be spaced at unequal distances with respect to each other.

The cutting elements 108 can include any structure or feature that facilitates cutting of food items, for example, mushrooms, tofu, avocado or other fruits, such as kiwi, when the food item is urged against the cutting elements 108. For example, the cutting elements 108 can include blades fabricated from a metallic material, or they can be strings or wires made from fabric, plastic, a metal, a combination thereof, or any other suitable material. Other cutting structures and material used to fabricate the cutting elements 108 are contemplated to fall within the scope of the present disclosure and the claims that follow.

Figure 2:
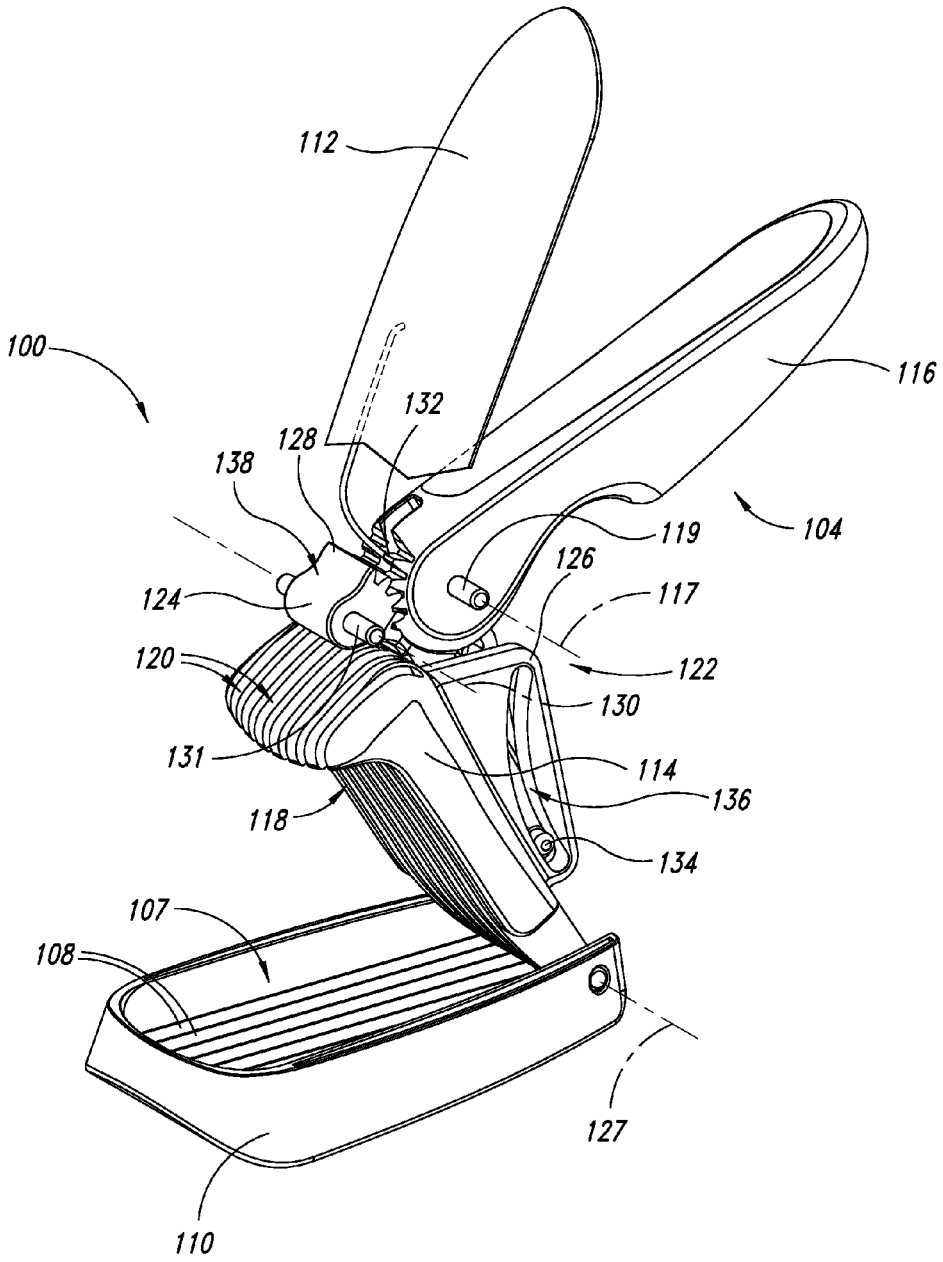
FIG. 2 is an isometric view of a working portion and a portion of a frame of the multiple slicing device of FIG. 1, according to one embodiment.

The working portion 104 of the slicing device 100 is more clearly illustrated in FIG. 2, with the housing 105 removed for clarity of illustration and description. The working portion 104 includes a forcing member 114 and a second handle 116. The second handle 116 is configured to be moved toward the first handle 112. For example, in the illustrated embodiment of FIG. 2, the second handle 116 is rotatably or pivotably coupled to the frame 102 via a pin 119 and configured to be rotated about a first axis 117. At least a first surface 118 of the forcing member 114 forms a portion of, or is positioned adjacent to, the receptacle 106 (FIG. 1). The forcing member 114 is pivotably coupled to a portion of the frame 102 (FIG. 1). In the illustrated embodiment of FIG. 2, the forcing member 114 is pivotably coupled to the base 110, and movement of the second handle 116 toward the first handle 112 causes the forcing member 114 to pivot with respect to the frame 102 and in a space defined by the receptacle 106, toward the cutting elements 108.

When the food item is placed in the receptacle 106, moving the second handle 116 toward the first handle 112 urges the forcing member 114 against the food item, forcing the food item against the cutting elements 108, which slice through the food item, simultaneously dividing the food item into multiple pieces. In one aspect, at least the first surface 118 of the forcing member 114 includes elongated recesses 120. The recesses 120 allow a portion of the forcing member, including the first surface 118, to move between the cutting elements 108 as the forcing member 114 pushes the food item past the cutting elements 108. The recesses 120 are sized and shaped to receive the cutting elements 108 after they cut through the food item, to ensure thorough slicing or cutting of the food item. In some embodiments, some or all of the elongated recesses 120 extend through an entire thickness of at least a portion of the forcing member 114.

In one embodiment, the working portion 102 further includes a cam mechanism 122 to convert movement of the second handle 116 toward the first handle 112 into movement of the forcing member 114 toward the cutting elements 108, and to collapse the forcing member 114 toward the cutting elements 108. In one embodiment, the cam mechanism 122 includes an elongated cam member 124 (best viewed in FIG. 4*c*) slidably coupled to a slotted cam member 126. The slotted cam member 126 is fixedly coupled to, or forms a portion of, the forcing member 114. In some embodiments, the slotted cam member 126 can be formed from a unitary body of material with the forcing member 114, for example, as an extension to the forcing member 114, extending rearwardly. The forcing member 114 and/or the slotted cam member 126 can be pivotably coupled to the frame 102 proximate or adjacent a location where the cutting elements 108 are mounted.

In the illustrated embodiment of FIG. 2, the forcing member 114 is pivotably coupled to the base 110 toward one end of the base 110, to pivot about a second axis 127. Therefore, the forcing member 114 and the slotted cam member 126 can pivot toward the cutting elements 108 as one unit.

The elongated cam member 124 can include a first gear 128 toward a first end 138 thereof. In one aspect, the first gear 128 is rotatably coupled to the frame 102 such that rotation of the first gear 128 rotates or pivots the elongated cam member 124 about a third axis 130. The first gear 128 is operatively coupled to a complementary second gear 132 positioned toward an end of the second handle 116. The first and second gears 128, 132 can be operatively coupled via complementary teeth formed on the first and second gears 128, 132, respectively. The second gear 132 can be fixedly coupled to, or formed from a unitary body of material with, the second handle 116.

In one embodiment, the elongated cam member 124 is slidably coupled to the slotted cam member 126. For example, the elongated cam member 124 can include a protrusion 134 and the slotted cam member 124 can include a slot 136 slidably receiving the protrusion 134. The protrusion 134 is spaced from the third axis 130 about which the elongated cam member 124 rotates or pivots.

Figure 3:
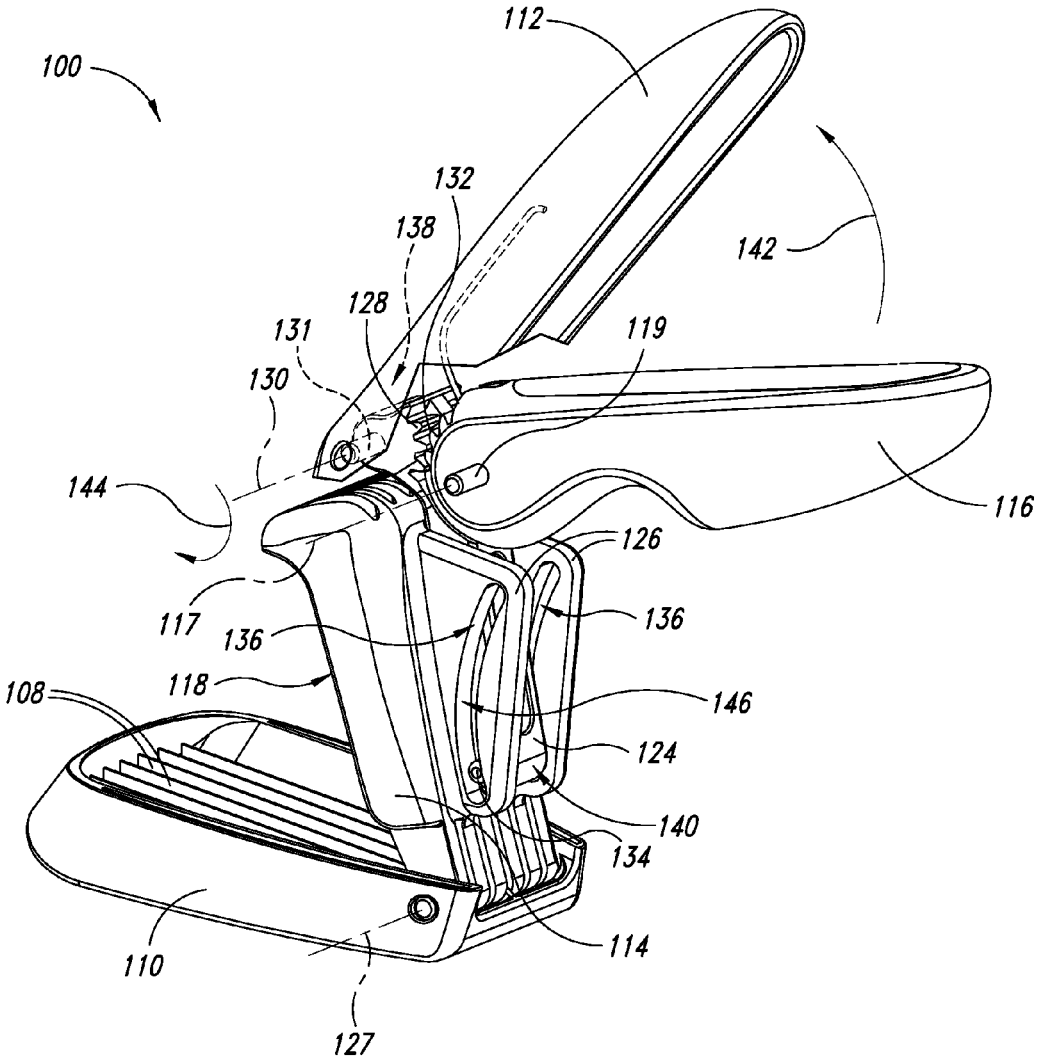
FIG. 3 is another isometric view of the working portion and the portion of the frame of FIG. 2, according to one embodiment.

In one embodiment, as illustrated in FIG. 3, when the user grips the first and second handles 112, 116, and urges the second handle 116 toward the first handle 112 in a first radial direction 142, the second gear 132 rotates the first gear 128 in a second radial direction 144, opposite the first radial direction 142. Because the first gear 128 is either fixedly coupled to, or formed from a unitary body of material with, the elongated cam member 124, the first gear 128 rotates the elongated cam member 124 about the third axis 130 in the second direction 144. The elongated cam member 124 is mounted such that its movement is substantially limited to rotation about the third axis 130. Therefore, rotation of the elongated cam member 124 results in the protrusion 134 sliding along, and bearing against, a portion of the slot 136 of the slotted cam member 126.

In one aspect, as illustrated in FIGS. 2 and 3, the elongated cam member 124 is rotatably mounted toward the first end 138 thereof, while the protrusion 134 is formed toward a second end 140 of the elongated cam member 124. Furthermore, the elongated cam member 124 can be mounted such that its movement is substantially limited to rotation about the third axis 130, for example, by being fixedly coupled to a pin 131 that is rotatably coupled with respect to the frame 102. Therefore, as the elongated cam member 124 rotates, it gains leverage from its axially and laterally fixed pivot point, such as the pin 131, and the protrusion 134 slides in the slot 136, exerting a force on at least a first surface 146 of the slot 136 and urging the slotted cam member 126, and therefore, the forcing member 114 toward the cutting elements 108.

Since the slotted cam member 126 is fixedly coupled to or formed from a unitary body of material with the forcing member 114, movement of the slotted cam member 126 urges the forcing member 114 to pivot about the second axis 127, the forcing member 114 moving toward the cutting elements 108. Therefore, when a food item is placed in the receptacle 106, moving the second handle 116 toward the first handle 112, pivots the forcing member 114, which in turn pushes against the food item, urging it against the cutting elements 108. As the forcing member 114 continues to push against the food item, the cutting elements 108 slice through the food item, dividing it into multiple pieces that can be respectively shaped in accordance with a pattern according to which the cutting elements 108 are mounted, formed or arranged.

As illustrated in FIG. 3, in some embodiments, the elongated cam member 124 can extend between two slotted cam members 126, having respective slots 136. The elongated cam member 124 can, in turn, include two opposing protrusions 134, one of which is shown in FIG. 3. The two protrusions 134 slidably engage the two slots 136, respectively, providing for added leverage and a smoother movement of the forcing member 114.

Figure 4A:
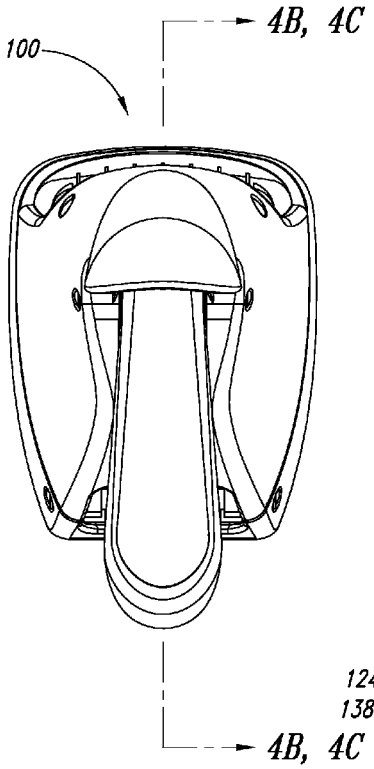
FIG. 4A is a top plan view of the multiple slicing device of FIG. 1.
Figure 4B:
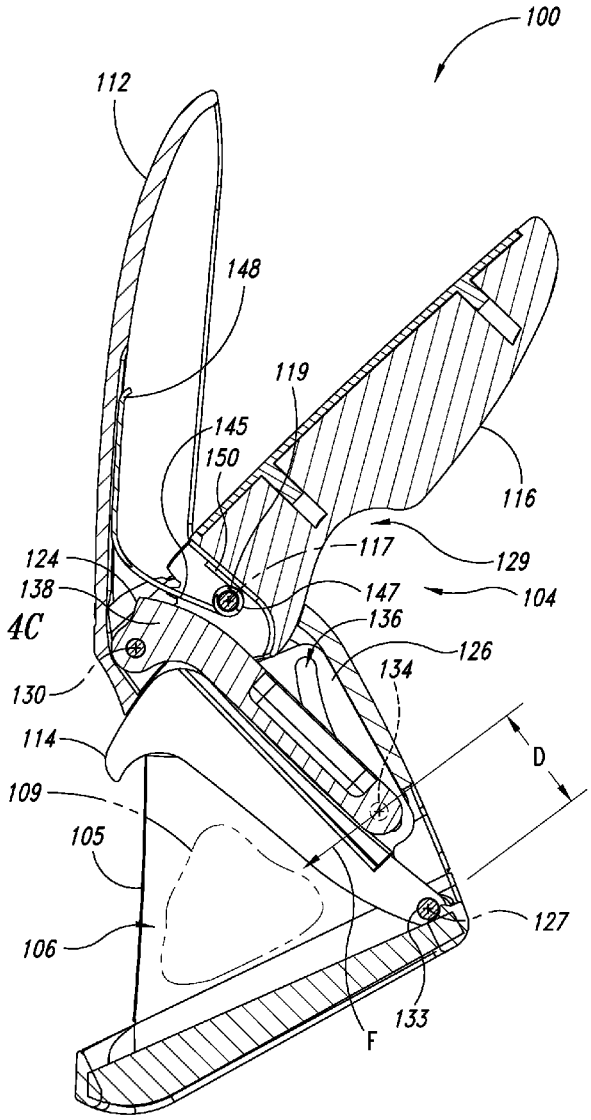
FIG. 4B is a cross-sectional view of the multiple slicing device of FIG. 4A viewed along Section 4B-4B, illustrating the device in a first state, with a food item placed in a receptacle of the device before being sliced.
Figure 4C:
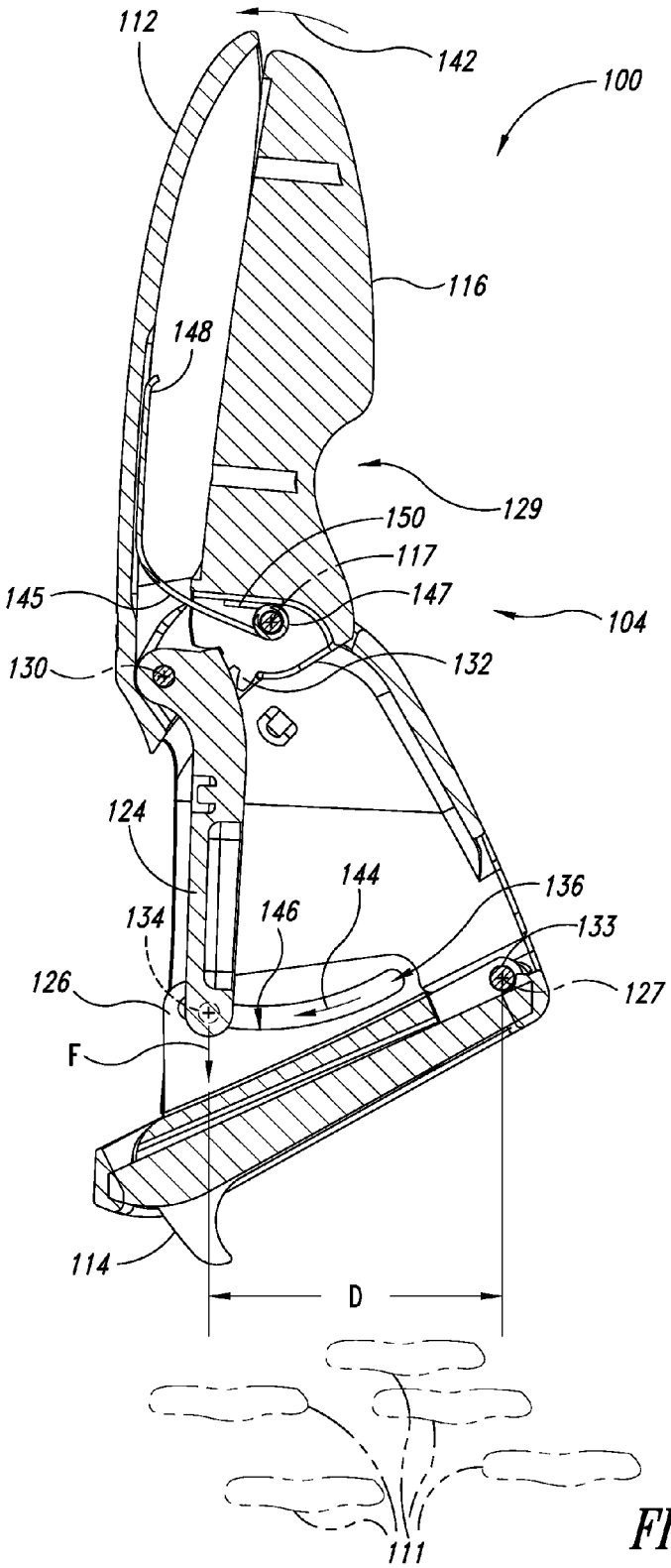
FIG. 4C is a cross-sectional view of the multiple slicing device of FIG. 4A viewed along Section 4C-4C, illustrating the device in a second state, with the food item from FIG. 4B sliced into multiple pieces.

The following discussion describes in more detail transition of the working portion 104 between a first, erected state, illustrated in FIG. 4B, and a second, collapsed state, illustrated in FIG. 4C. As illustrated in FIG. 4B, before actuation of the second handle 116 toward the first handle 112, the forcing member 114 is in the first, erected state, allowing the user to place a food item 109 in the receptacle 106 formed by the housing 105.

As illustrated in FIG. 4C, the second handle 116 is moved toward the first handle 112 by being rotated in the first radial direction 142 about the first axis 117. Movement of the second handle 116 has rotated the elongated cam member 124 in the second radial direction 144, opposed to the first radial direction 142, about the third axis 130. Through this motion, the protrusions 134 slide along the slots 136, respectively, and against at least one surface 146 of the respective slots 136, from the position shown in FIG. 4B to the position shown in FIG. 4C, to move the forcing member 114 toward the cutting elements 108 and simultaneously slice the food item 109 into multiple piece 111.

The forcing member 114 is pivoted in response to a force F exerted on it by the protrusion 134. The forcing member 114 pivots as a result of a moment applied thereto, the magnitude of which is proportional to the force F and a distance D between the protrusion 134 and the location at which the forcing member 114 is pivotably mounted along a direction perpendicular to a direction of the force F. In the illustrated embodiment of FIGS. 4B and 4C, the forcing member 114 is pivotably mounted, for example, via a pin 133 rotatably mounted to the base 110 and extending along the second axis 127. Because the protrusion 134 slides along the slot 136, the distance D increases as the protrusion 134 slides from the first, erected state shown in FIG. 4B toward the second, collapsed state shown in FIG. 4C. Accordingly, the moment acting on the forcing member 114 increases in magnitude as the protrusion 134 slides along the slot 136. Therefore, the protrusion 134 more effectively leverages the forcing member 114 against its axially and laterally fixed pivot point or component, such as the third pin 133, to push the forcing member 114 against the food item 109 with increasing moment, and efficiently slice the food item 109 into multiple pieces as the food item 109 is cut by the cutting elements 108.

In addition, this configuration allows the user to easily use one hand to grip the first and second handles 112, 116, and rotate the second handle 116 toward the first handle 112. The user can apply an approximately constant force to move the second handle 116 toward the first handle 112 while the moment on the forcing member 114 increases. Alternatively, the user can apply less force as the second handle 116 is moved toward the first handle 112 while the moment on the forcing member 114 remains substantially unaffected. Therefore, food items can be sliced or otherwise processed through cutting elements 108 without requiring excessive force. This configuration also improves the useful life of the device 100 because its components are subjected to more moderate forces during the operation, substantially preventing premature deterioration of the components.

As the cutting elements 108 cut into the thickness of the food item 109, the resistance of the food item 109 against movement of the forcing member 114 toward the cutting elements 108 may tend to increase depending on the type of food item desired to be sliced. The multiple slicing device 100 is particularly useful in slicing food items that may impose such resistance because it is configured to increase the moment on the forcing member 114 to counteract and overcome any cutting resistance which may be encountered.

In one embodiment, as illustrated in FIGS. 4B and 4C, the slicing device 100 includes a biasing member 145 positioned between the second handle 116 and a portion of the frame 102, such as a portion of the first handle 112. The biasing member 145 acts to return the second handle 116 and with it, the forcing member 114 to their respective original positions, before actuation of the second handle 116, for cleaning the multiple slicing device 100 or placing another food item in the receptacle 106. In one embodiment, the biasing member 145 includes a coiled portion 147 and first and second extensions 148, 150 respectively engaging the first and second handles 112, 116. The coiled portion 147 can be wound around the pin 119, which in turn is rotatably mounted to the frame 102 and fixedly coupled to the second handle 116. Other embodiments can incorporate any other type of biasing member that urges the second handle 116 toward its original position after being activated and released.

Furthermore, in the illustrated embodiment of FIGS. 4B and 4C, the slot 136 is an elongated arcuate slot. One of ordinary skill in the art will appreciate that the slot 136 can have any other shape that facilitates sliding engagement between the elongated cam member 124 and the slotted cam member 126. Moreover, the slotted cam member 126 and/or the elongated cam member 124 can include any other configuration that provides for a portion of the elongated cam member 124 to slide along a portion of the slotted cam member 126, and pivot the forcing member 114 toward the cutting elements 108, to achieve efficient slicing or processing of food items as discussed above.

One of ordinary skill in the art will appreciate that the first and second handles 112, 116 can be modified in different embodiments, for achieving various configurations of manipulating the working portion 104. For example, in the illustrated embodiment of FIGS. 4B and 4C, the second handle 112 includes a recess 129 so that when the user places the first handle 112 in the user's palm, at least one finger can be placed in the recess 129 to ergonomically force the second handle 116 toward the first handle 112. This and other ergonomic features of the first and/or second handles 112, 116, and of other components, are contemplated to be within the scope of the present disclosure and the claims that follow. Furthermore, in other embodiments, the first and second handles 112, 116 may be smaller and configured to be engaged with two fingers to move one handle toward the other handle.

Additionally, although in the foregoing embodiments movement of the first handle 112 is not discussed, a person of ordinary skill in the art will appreciate that either or both handles 112, 116 may be mounted to pivot or rotate with respect to the frame 102. For example, in one embodiment, the teeth of the first gear 128 at the end of the elongated cam member 124 can extend further about the first gear 128, than that shown in FIGS. 2 and 3. In such an embodiment, the first handle 112 can include a third gear (not shown), and be pivotably or rotatably mounted to the frame 102, similar to the above-described second handle 116. Furthermore, the third gear can be operatively coupled to a portion of the first gear 128 via an intervening gear (not shown). In this manner movement of the first handle 112 toward the second handle 116 in the second direction 144 (FIG. 3) will pivot the elongated cam member 124 in the second direction 144.

In such an embodiment, the second handle 116 can be fixedly mounted without being operatively coupled to the elongated cam member 124 via a gear mechanism. Alternatively, the second handle 116 can be operatively coupled to the elongated cam member 124 as described above, and both handles 112, 116 can contribute to pivoting the elongated cam member 124 as they are forced toward each other.

Furthermore, the cutting elements 108 can be arranged in any pattern. In some embodiments, the cutting element or elements can be formed to slice or process the food item into particular shapes or forms.

Figure 5A:
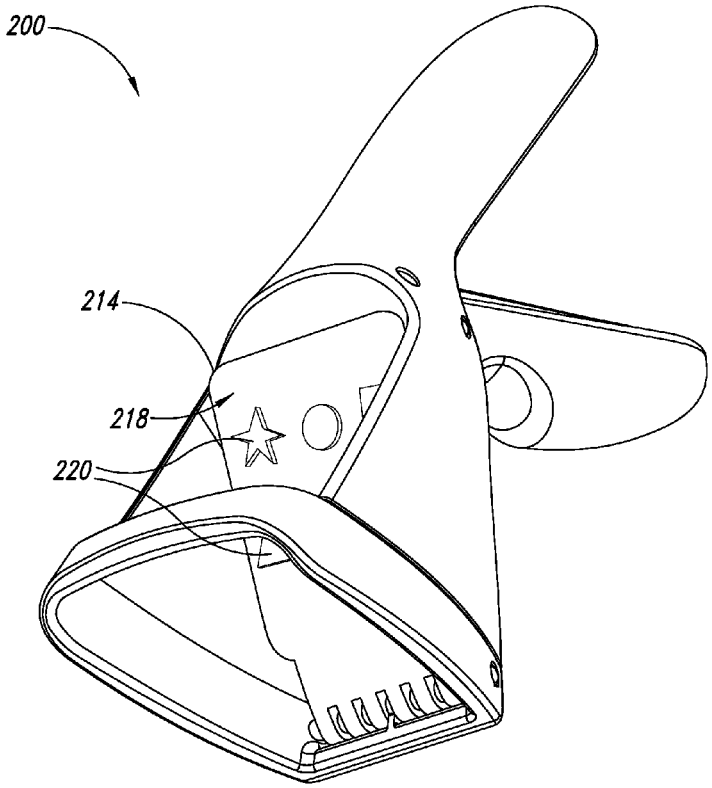
FIGS. 5A-5C illustrate a multiple slicing device according to another embodiment and first and second cutting elements that can be alternatively used with the multiple slicing device.
Figure 5B:
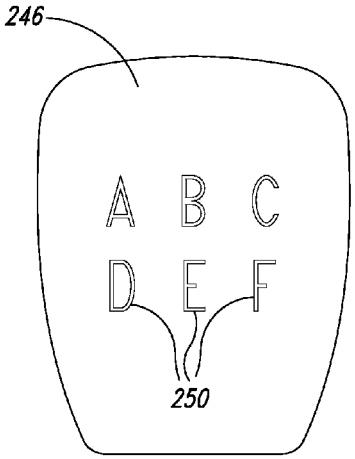
Figure 5C:
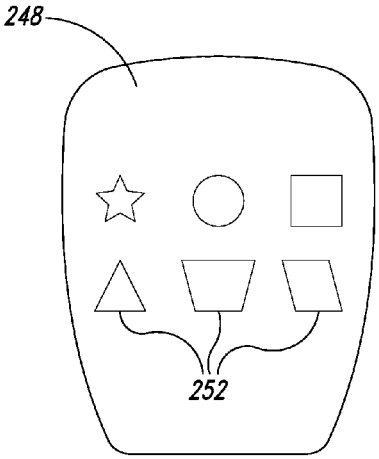

For example, FIG. 5 illustrates a slicing device 200 according to another embodiment having similar features as those described above and configured to receive various cutting elements such as the illustrated first and second cutting plates 246, 248. The first and second cutting plates 246, 248 each include one or more cutouts 250, 252, which can have various shapes or resemble figures or characters such as letters in an alphabet. This embodiment may be useful for pastry applications including sizing pastry pieces for primary pastry items or for decoration added to primary pastry items. Furthermore, such cutting plates can be useful for processing other food items to achieve desired shapes to provide an aesthetic appeal to a dish. Edges of the cutouts 250, 252 can be sharp and/or be slightly raised to facilitate cutting or slicing the food item at the boundary of the respective cutouts 250, 252. The base 210 of the frame 202 can include a coupling feature configured to be removably coupled to the cutting plates 242, 244, or to other cutting elements, to allow removing and replacing the cutting plates 246, 248 to switch between slicing or cutting patterns or to replace worn cutting plates.

Furthermore, a first surface 218 of the forcing member 214 can include protrusions 220 shaped and sized substantially similar to corresponding cutouts 250, 252, to force the cut or sliced portion of the food item through the cutouts 250, 252 as the forcing member 214 descends toward the cutting plates 246, 248. The protrusions 220 can be formed on a sheet that is removably coupled to the forcing member 214 to form the first surface 218 so that the sheet can be removed and replaced with another sheet having protrusions, which correspond to the cutouts of a cutting plate that is desired to be used.

All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A hand operated device for slicing an article of food into multiple slices with one hand, the device comprising:

a body having a base, a housing, and a fixed handle, the base comprising a plurality of blade members arranged in an array, the housing creating an open area immediately above the blades, and the fixed handle projecting upwards from the housing;

a forcing member movably coupled to the body to move between a first position in which at least a portion of the forcing member is spaced apart from the blades so that the article of food can be placed therebetween, and a second position in which the forcing member is engaged with the blades;

a cam member pivotably coupled to the body, the cam member being positioned to slidably contact the forcing member and adapted to move the forcing member between the first and second positions as the cam member pivots; and an actuator movably coupled with respect to the fixed handle and operatively coupled to the cam member such that an operator can squeeze the actuator toward the fixed handle to pivot the cam member and, in turn, move the forcing member between the first position to the second position to slice the article of food, wherein the forcing member is pivotally coupled to the base and configured to pivot between the first and second positions.

2. The device of claim 1 wherein the array of blade members extends across substantially all of the base.

3. The device of claim 1 wherein the cam member is configured such that the force applied to the forcing member increases as the forcing member moves from the first position to the second position.

4. A hand operated device for slicing an article of food into multiple slices with one hand, the device comprimising;

a body having a base, a housing, and a fixed handle, the base comprising a plurality of blade members arranged in an array, the housing creating an open area immediately above the blades, and the fixed handle projecting upwards from the housing;

a forcing member movably coupled to the body to move between a first position in which at least a portion of the forcing member is spaced apart from the blades so that the article of food can be placed therebetween, and a second position in which the forcing member is engaged with the blades;

a cam meber pivotably coupled to the body, the cam member being positioned to slidably contact the forcing member and adapted to move the forcing member between the first and second positions as the cam member pivots; and an actuator movably coupled with respect to the fixed handle and operatively coupled to the cam member such that an operator can squeeze the actuator toward the fixed handle to pivot the cam member and, in turn, move the forcing member between the first position to the second position to slice the article of food, wherein the forcing member and actuator are pivotally coupled to the body and the actuator and cam member are linked to the forcing member to cause the forcing member to pivot in response to pivoting movement of the actuator.

5. A hand operated device for slicing an article of food into multiple slices with one hand, the device compromising;

a body having a base, a housing, and a fixed handle, the base comprising a plurality of blade members arranged in an array, the housing creating an open area immediately above the blades, and the fixed handle projecting upwards from the housing;

a forcing member movably coupled to the body to move between a first position in which at least a portion of the forcing member is spaced apart from the blades so that the article of food can be placed therebetween, and a second position in which the forcing member is engaged with the blades;

a cam member pivotably coupled to the body, the cam member being positioned to slidably contact the forcing member and adapted to move the forcing member between the first and second positons as the cam member pivots; and an actuator movably coupled with respect to the fixed handle and operatively coupled to the cam member such that an operator can squeeze the actuator toward the fixed handle to pivot the cam member and, in turn, move the forcing member between the first position to the second position o slice the article of food, wherein the forcing member and actuator are pivotally coupled to the body and the actuator and cam member are linked to the forcing member to cause the forcing member to pivot in a first rotational direction in response to pivoting movement of the actuator in an opposing second rotational direction.

* * * * *

UNITED STATES PATENT AND TRADEMARK OFFICE

CERTIFICATE OF CORRECTION

PATENT NO. : 8,991,291 B2
APPLICATION NO. : 13/768808
DATED : March 31, 2015
INVENTOR(S) : David A. Holcomb et al.

It is certified that error appears in the above-identified patent and that said Letters Patent is hereby corrected as shown below:

In the Claims:

Column 8, Line 7:
"a cam meber pivotably coupled to the body, the cam mem-" should read, --a cam member pivotably coupled to the body, the cam mem- --.

Column 8, Line 46:
"second position o slice the article of food" should read, --second position to slice the article of food--.

Signed and Sealed this
Twenty-sixth Day of July, 2016

Michelle K. Lee

Michelle K. Lee
*Director of the United States Patent and Trademark Office*